United States Patent [19]

Spanel

[11] 3,937,159

[45] Feb. 10, 1976

[54] YARN CLAMPING MEANS FOR TUFTING APPARATUS

[76] Inventor: Abram N. Spanel, 344 Stockton St., Princeton, N.J. 08540

[22] Filed: May 29, 1974

[21] Appl. No.: 474,266

[52] U.S. Cl. ..... 112/79 R; 112/235

[51] Int. Cl.[2] ..... D05C 15/16

[58] Field of Search ..... 112/60, 76, 114, 79 R, 112/79 A, 79 FF, 79.5, 235, 236, 237

[56] References Cited

UNITED STATES PATENTS

| | | | |
|---|---|---|---|
| 2,887,966 | 5/1959 | Felton | 112/79.5 |
| 2,989,014 | 6/1961 | Dedmon | 112/79 R |
| 3,095,840 | 7/1963 | Ballard | 112/79 R X |
| 3,220,371 | 11/1965 | Short et al. | 112/79 R X |
| 3,386,403 | 6/1968 | Short | 112/79 R X |

*Primary Examiner*—H. Hampton Hunter

*Attorney, Agent, or Firm*—Steele & Petock

[57] ABSTRACT

Yarn clamping means for clamping yarn during a desired portion of the tufting cycle. Various biasing means and related structures are disclosed to effectively clamp the yarn while loaded in tufting needles, thus preventing dislodgement of the yarn by factors such as yarn severing or yarn thrust from pneumatic transport means.

20 Claims, 8 Drawing Figures

C
C
C
C
C
10
11
12
13
14
16
18
20
22
24
26
28
30
32
34
36
38
38
38
38
40
42
44
46
48
50
52
L
M
CLOCK PULSES

YARN CLAMPING MEANS FOR TUFTING APPARATUS

BACKGROUND OF THE INVENTION

The subject invention may be utilized with various tufting systems, however, it has particular utility in the "Spanel tufting system" in which yarn strands or bit-lengths of yarn are pneumatically transported to a tufting station where they are implanted in a backing layer by bit-applying elements, such as double needles.

The Spanel tufting system is described in other Spanel patents, including U.S. Pat. No. 3,554,147, which issued to Abram N. Spanel and George J. Brennan on Jan. 12, 1971 and U.S. Pat. No. Re. 27,165 which issued Aug. 10, 1971 to Abram N. Spanel and Lloyd E. Barton.

The aforementioned U.S. Pat. No. Re. 27,165 discloses a pneumatic yarn transport system in which yarn strands and/or discrete bits of yarn are transported pneumatically to a tufting station where they are applied by tufting elements to a backing. Multicolor selection of the yarn bits is enabled by a shifting magazine arrangement which provides yarn of various colors to each of the guide tubes through which yarn is transported to the tufting elements. When the yarn strand or bit reaches the tufting station and threads the dual needles as seen in FIGS. 22A–22D of U.S. Pat. No. Re. 27,165, the yarn impacts against a stop member 23A which maintains it in a desired position relative to the needles preparatory to tufting.

It will be appreciated that in Spanel U.S. Pat. No. Re. 27,165, emphasis was placed on suction, or negative pressure as a means for providing pneumatic yarn transport. A bit-length of yarn was secured in the loading position within the confines of the suction manifold 21, tube passageway 12 and the stop means 23. In later versions of the "Spanel tufting system" as disclosed in co-pending Spanel Application Ser. No. 419,417, a pneumatic yarn transport means employing positive pressure is described. In this application, the yarn bit stop is eliminated and in its place, clamping means are disclosed for holding a yarn bit-length in place in the loading position prior to the tufting operation.

In addition, Spanel Applications Ser. No. 474,264 and Ser. No. 474,265, filed concurrently with the subject application, disclose tufting systems in which the subject invention may be utilized.

In tufting developments which are related and take advantage of Spanel concepts, Ellison British Specification No. 1,339,594 discloses a clamp means which is utilized with Spanel double needles but which, however, is structurally and operationally sharply dissimilar. The Ellison clamp extends through the upper portion of each set of needles as contrasted to the subject clamping means which is described herein.

BRIEF SUMMARY OF THE INVENTION

In accordance with the subject invention, the yarn clamping means disclosed herein are designed to provide resilient clamping against each discrete yarn bit-length or each group of bit-lengths to secure them in tufting needle means for a desired portion of the tufting cycle. A lifter bar mechanism, when positively actuated, lifts or otherwise disengages the clamping means from the yarn bit-lengths.

In one of the embodiments, the bit clamps are configurated to enable compression springs to provide the resiliency. In other embodiments, resiliency is provided by finger springs, by wedge springs, by a substantially continuous resilient compression strip and by pneumatic pressure means.

It should be noted that, with yarn clamping means which do not provide the resilient clamping just described, variations in yarns and machine dimensions from one bit-length to another can cause serious clamping malfunctions.

DETAILED DESCRIPTION

Figure 1:
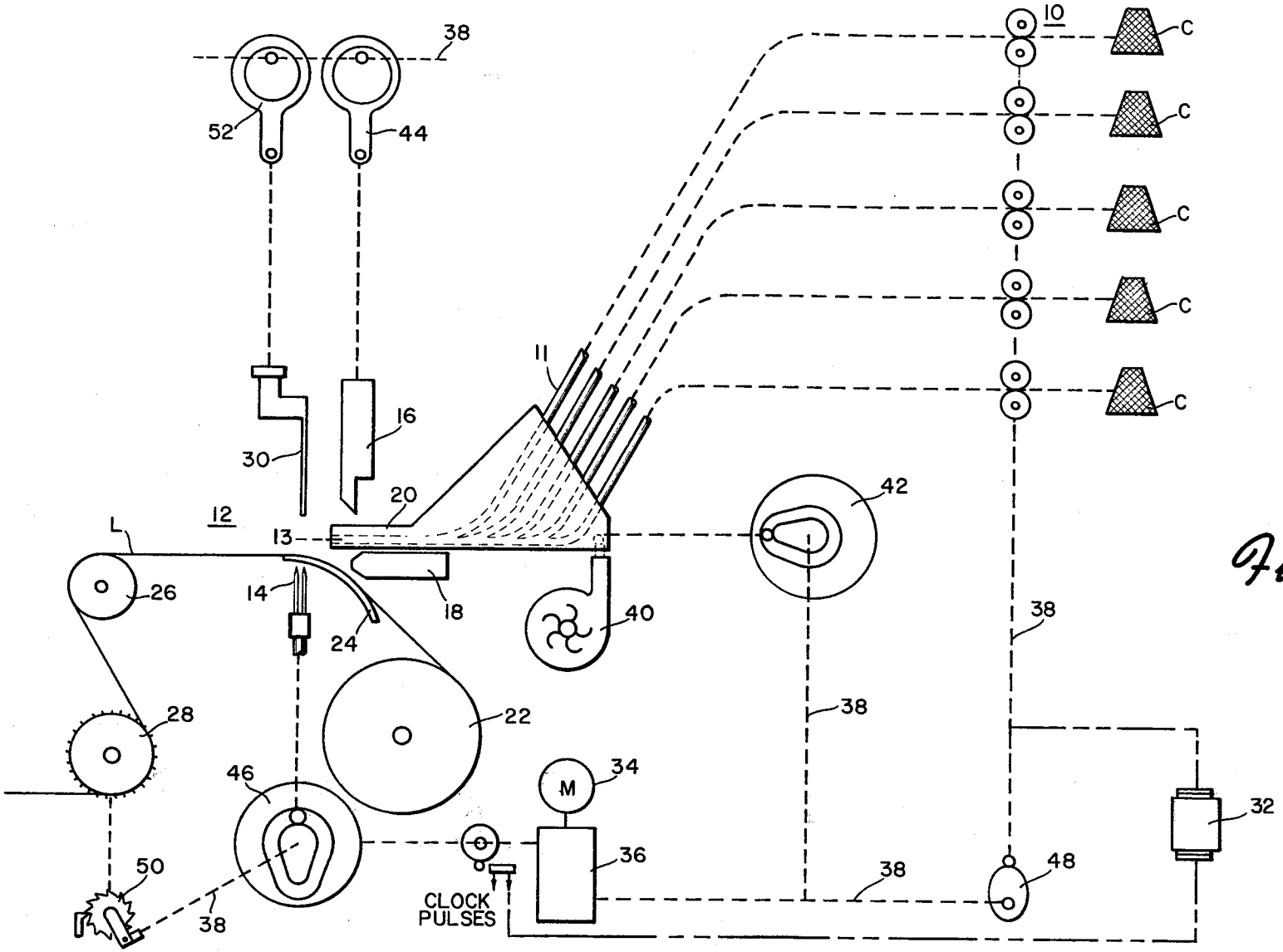
FIG. 1 is a schematic view of one type of tufting apparatus in which the subject invention may be used.

The subject yarn clamping means may be utilized in a tufting system such as shown schematically in FIG. 1. Yarn is advanced from creels C by means of metering and feeding stations 10. A desired number of yarn strands, which is not limited to the five strands shown in FIG. 1, may be transported through passageways 11 where a selected one of the yarn strands is transported by means of a common passageway 13 in shuttle nose 20 to a needle station 12 for tufting into a backing L by means of bit-applying elements such as needles 14. The yarn strand may be severed by severing means such as knife 16 which is aligned to impact against anvil means 18 when reciprocating shuttle nose 20 is drawn to the right. The reciprocating shuttle nose 20 abuts the needles 14 when they are in their uppermost position through the backing layer L, thus permitting the yarn strand to be deposited in the needles 14. When the strand is severed, a discrete bit-length of yarn is left in the needles 14 for tufting into backing L.

The backing L is fed from feed roll 22, past backing guide 24, and is directed by idler roll 26 to take up roll 28. A yarn clamping means, as will be described in detail, is shown schematically as 30.

A selection actuation means 32, which may be a solenoid or other suitable control device, such as mechanical, pneumatic or hydraulic actuated devices, receives control signals via which it programs operation of yarn metering and feeding stations 10 so as to reproduce a desired yarn pattern on the backing. These control signals are synchronized with other machine functions as represented by the clock pulses shown as dashed lines.

A motor 34 is shown driving the machine through transmission 36 which may include trains of gears or other mechanisms. A shaft 38 is schematically shown running throughout the device which transmits power to the various mechanisms.

A pneumatic supply source 40 is shown with a valve operated by cam member 42. The knife 16 is driven by eccentric member 44 while the needle means 14 is driven by cam member 46. The yarn metering and feeding means 10 may be controlled by cam member 48 while the backing drive roll 28 may be controlled by rachet and pawl means 50. The yarn clamping means 30, which will be described subsequently, operates by means of eccentric member 52. Thus, generally, the tufting operation comprises the selection of a yarn strand having a particular color or other desired characteristics, the feeding and metering of that particular strand, including the transport by pneumatic means to the needle station 12 where the yarn strand may be threaded into needles 14, clamped in place, and severed by knife 16 into a discrete bit-length of yarn for tufting into the backing L.

The operation may also include a yarn pullback function to remove the unsevered portion of a yarn strand from the common passageway 13 prior to feeding a succeeding yarn strand, as described in co-pending Spanel Application Ser. No. 474,264.

Figure 2:
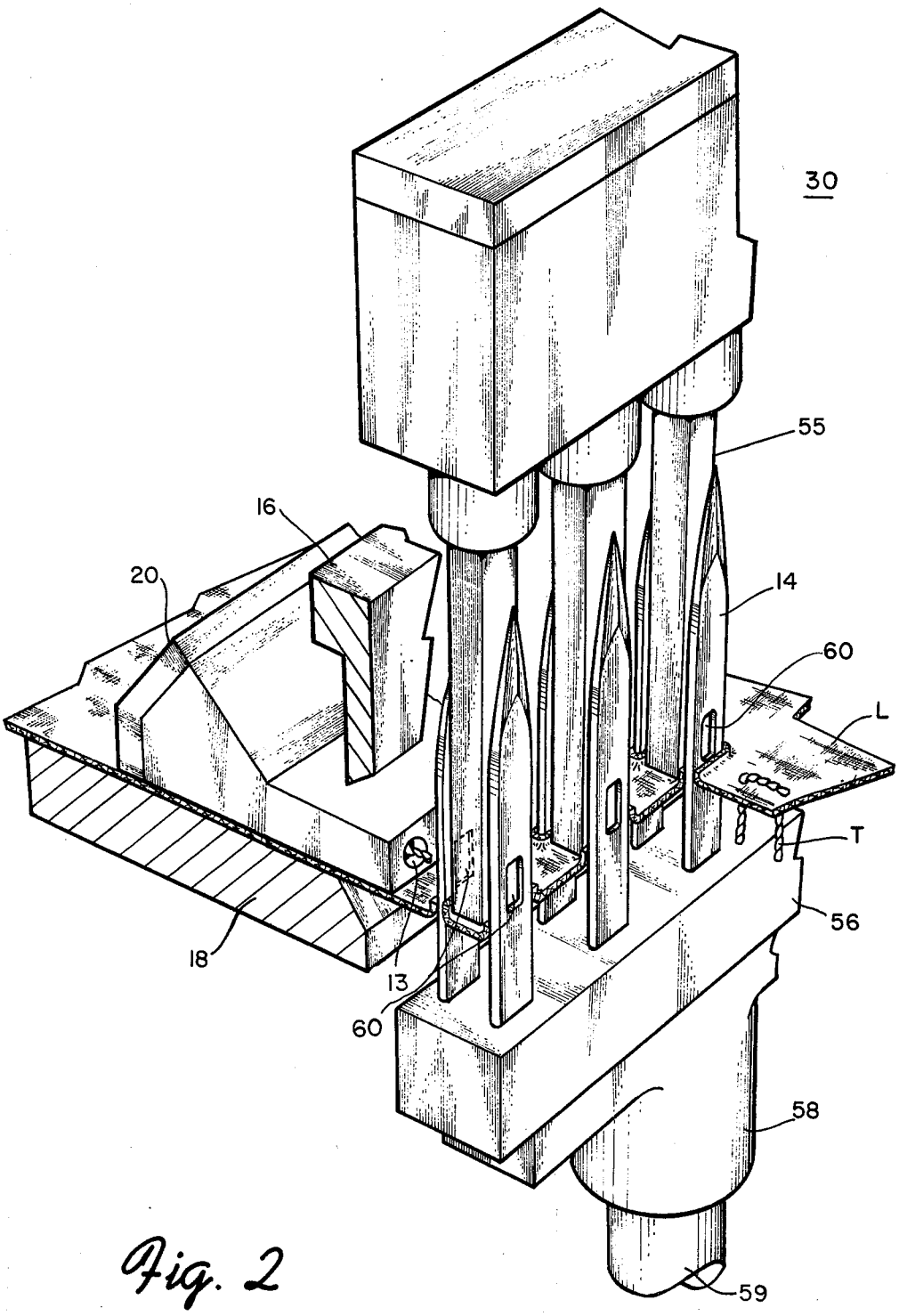
FIG. 2 is a perspective view showing the clamping means utilized with a series of yarn tufting needles.

As seen in FIG. 2, needles 14 are laterally positioned widthwise across the tufting machine with yarn clamping means designated generally as 30 having individual bit clamps 55 in alignment with the needles 14.

The needles 14, having eyes 60, are mounted on needle bar 56 which is supported on push foot 58 of push rod 59 which via cam 46 (see FIG. 1) provides reciprocable motion to the needle bar 56 and needles 14. For each of the needles 14, a selected yarn strand is advanced through common passageway 13 into the aligned needle eyes 60 when the yarn clamping means 30 is in a raised load position and the bit clamps 55 are above the needle eyes 60. The yarn clamping means 30 then descends, and bit clamp 55 descends against the yarn strand, thus clamping it against needle eyes 60.

The reciprocating shuttle nose 20 retracts to the left and the knife 16 descends to sever the yarn strand against anvil 18. The needles 14 descend and each severed length is implanted in the backing L to form a tuft T.

Figure 3:
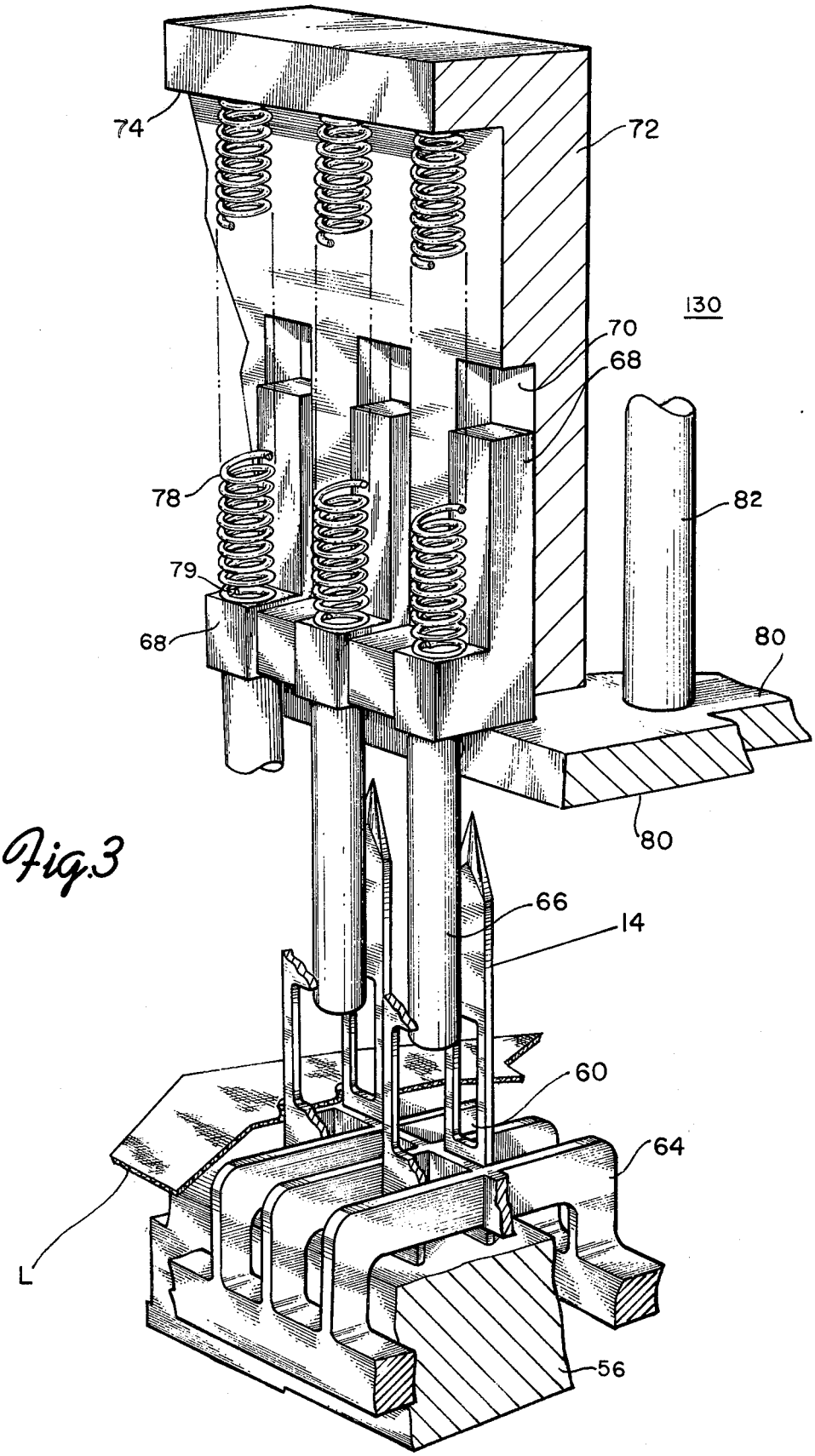
FIG. 3 is a perspective view showing a specific embodiment of clamping means wherein compression springs are used to bias the clamping means into their engagement positions.

The first of a series of yarn clamping means is disclosed in detail in FIG. 3 which, in addition to the needle structure of FIG. 2, shows the backing L being supported by stripper and bit clamp backup 64 which is a grating-like support device having spaces through which the needles 14 may project upwardly. The yarn clamping means 130 in FIG. 3 includes bit clamps 66 which extend downwardly from L-shaped bit-clamp body members 68, which are reciprocable within bit-clamp guide slots 70, cut from or molded into bit-clamp guide structure 72. The bit-clamp guide structure 72 has an upper cantilevered portion 74 which extends above the lower portion of L-shaped clamp body members 68. Compression springs 78, restrained by depressions 79, extend from the cantilevered portion 74 of the clamp guide structure 72 to the lower portion of clamp body members 68. The compression springs 78 bias the bit clamps 66 downwardly against yarn that is loaded in needle eyes 60.

A lifter bar 80 is positioned below the bit clamp bodies 68 and is secured to drive bar 82 which may be driven by cam 52 (see FIG. 1).

In operation, it will be appreciated that when the lifter bar 80 is lowered, the bit clamps 66 are biased into engagement with the corresponding yarn strands, thus preventing movement of the strands relative to the needles 14 until the needles descend and implant the bit-lengths of yarn, into backing L. After tufting, the lifter bar 80 is raised causing the bit clamps 66 to release their clamp of the yarn bits. The backing L then may be shifted to the right, and the needles 14 raised to their loading position preparatory to the next cycle.

Figure 4:
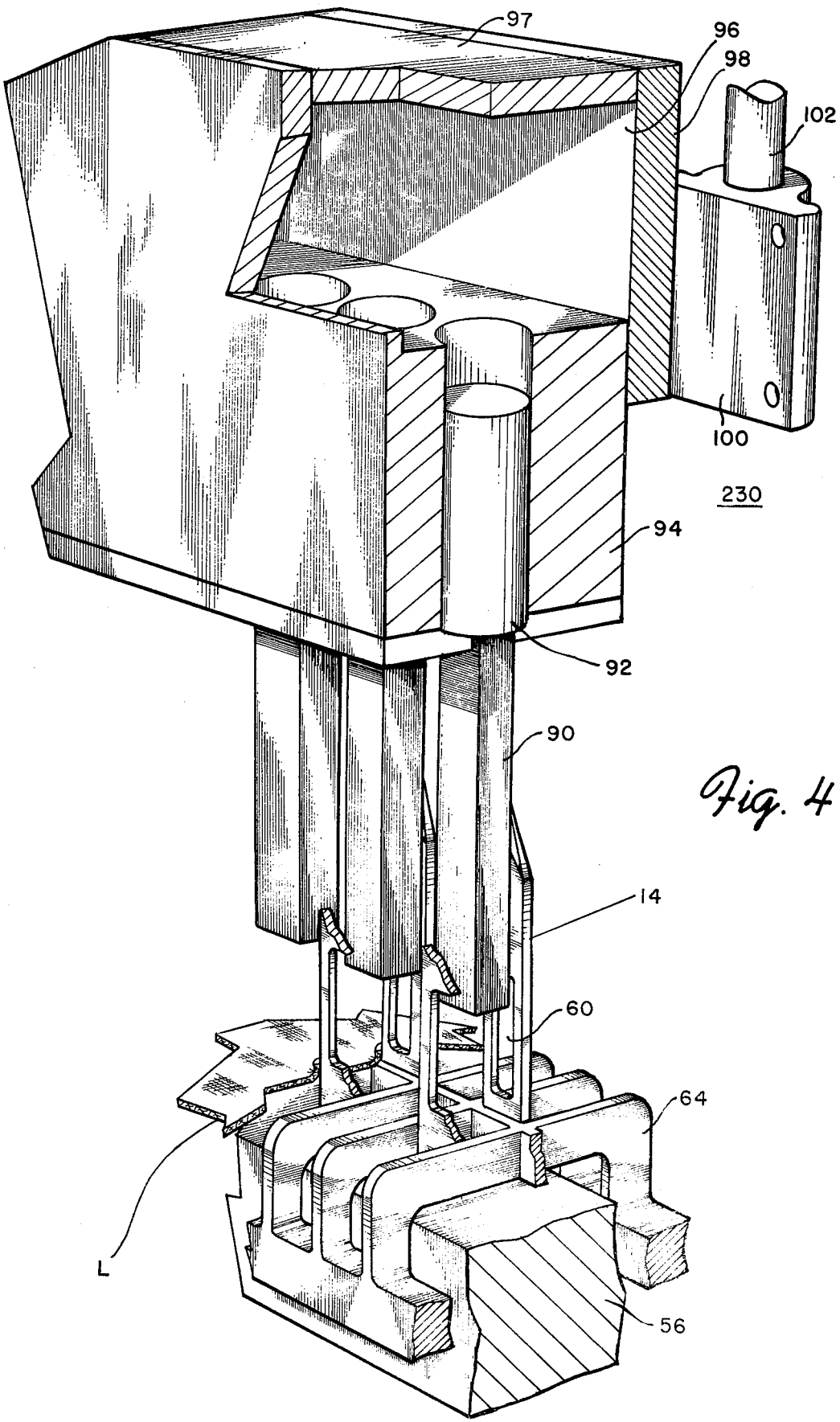
FIG. 4 is a perspective view showing pneumatic clamping means utilizing piston type actuators.

With respect to FIG. 4, a modified yarn clamping means 230 is disclosed. Bit clamps 90 which, as with any of the bit clamps described herein, may be of any desired cross-sections, extend downwardly from pistons 92 which serve as bit clamp carriers. The pistons 92 are housed within cylinder block 94 above which is located pneumatic pressure chamber 96. Cover plates 97 and 98 complete the wall structure for this chamber. A lifter bar foot member 100 is secured to the cover plate 98 and a drive bar 102 provides the drive for reciprocating vertically the entire yarn clamping means 230.

The yarn clamping structure 230 of FIG. 4 may be utilized by driving the unit into and out of a clamping position by means of one or more drive bars 102 operating from cam 52 (FIG. 1). Alternately, the structure 230 may be mounted to the main frame of the machine and the desired motion of the bit clamps 90 and pistons 92 produced entirely by pneumatic means, i.e., programming of pneumatic pressure (including positive and negative) in chamber 96.

Figure 5:
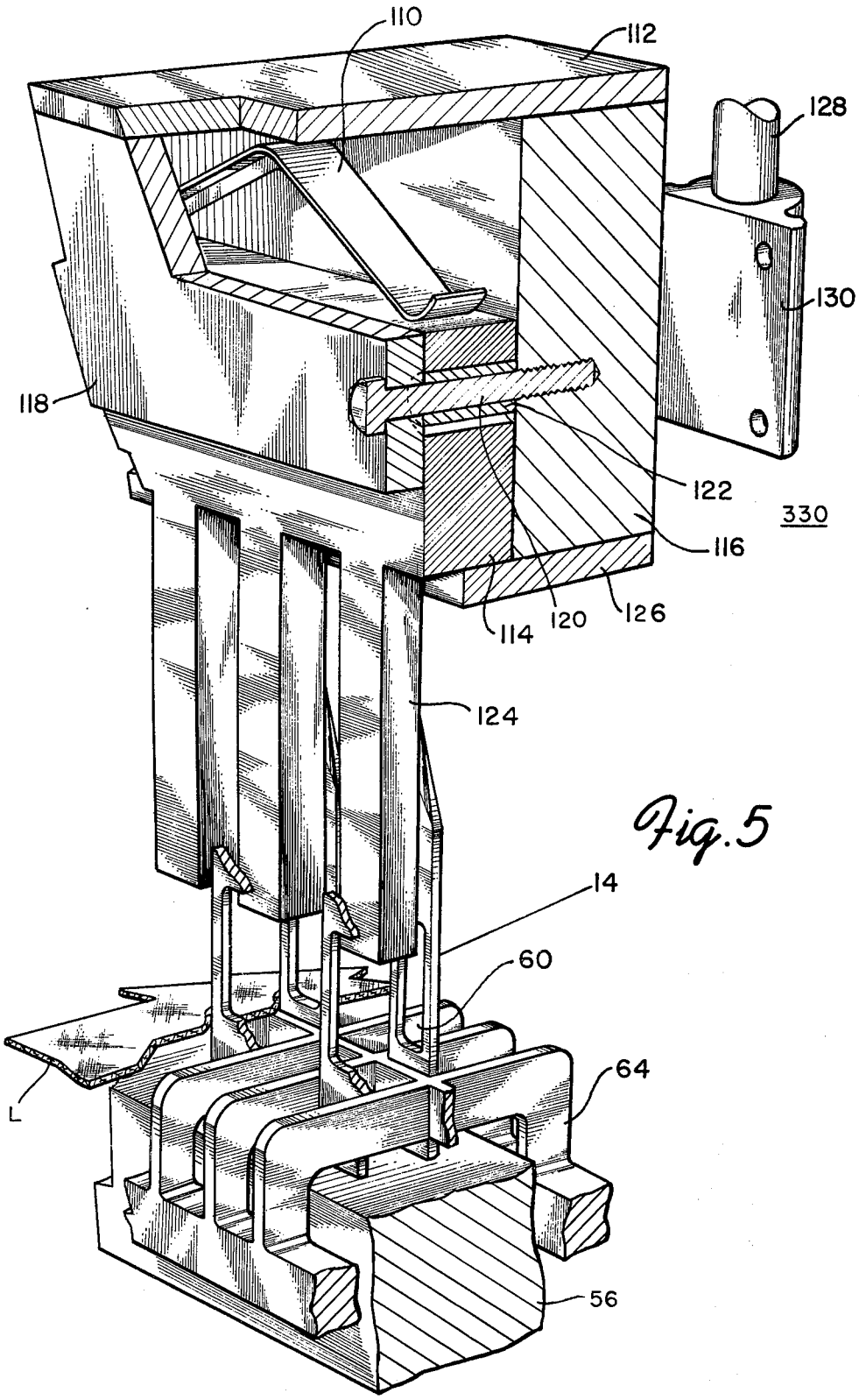
FIG. 5 is a perspective view showing clamping means utilizing wedge type springs.

With reference to FIG. 5, another design of yarn clamping means 330 is shown. A wedge shaped member 110 constructed of spring steel or other suitable material is positioned between cover plate 112 and a bit clamp body member 114. A bit clamp carrier bar 116 and a retainer plate 118 are secured by means of bolt member 120. Bit clamp body 114 has a guide slot 122 through which the bolt member 120 extends with tolerances such as to permit the biasing effect of the wedge shaped member 110 to be effective against bit clamp body member 114. The bit clamps 124 are shown integral with the bit clamp body 114. A lifter plate 126 is secured to the base of bit clamp carrier bar 116 and extends below bit clamp body 114. Vertical reciprocation or the unit occurs by means of drive bar 128, and bit clamp lifter foot 130, which is secured to bit clamp carrier bar 116.

In the clamp means 330 of FIG. 5, member 110 biases the bit clamp body 114 to impart the desired resilient effect to bit clamps 124 while the reciprocation of drive bar 128 causes the bit clamps 124 and remainder of unit to be raised to permit needle loading and lowered to clamp the yarn. It should be noted that in this embodiment, independent resiliency is not provided for each bit clamp but for each group, where each group contains a desired plurality of bit clamps.

Figure 6:
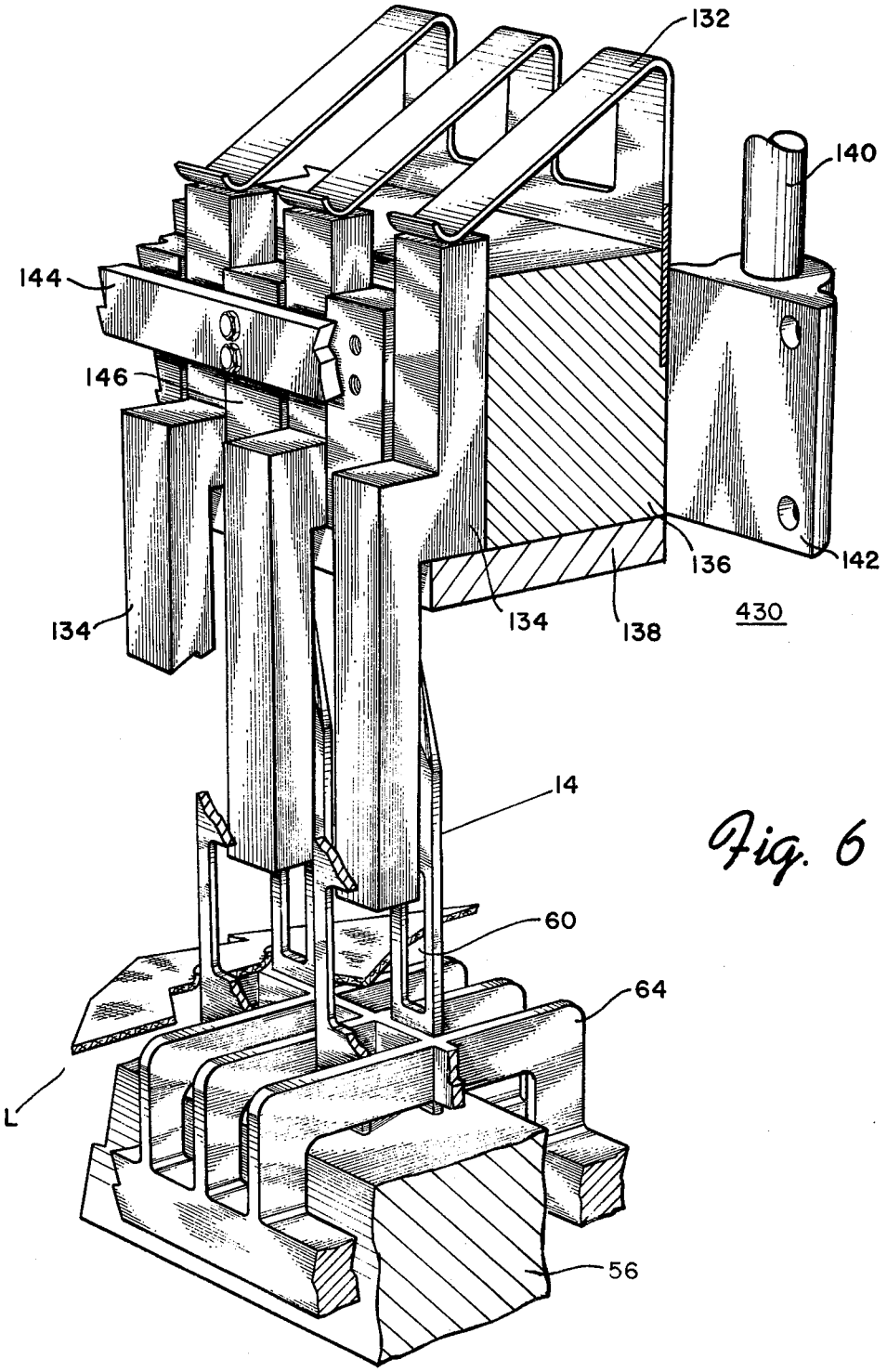
FIG. 6 is a perspective view showing the use of finger springs for biasing the clamping means.

With respect to yarn clamping means 430 of FIG. 6, finger springs 132 individually bear against bit clamps 134 to impart a biasing effect thereon. The bit clamp carrier bar 136 has the finger springs 132 mounted thereto and lifter plate 138 is secured to bit clamp carrier bar 136 and extends beneath the upper portion of bit clamp 134 as shown. Drive bar 140 is secured to the drive foot 142 which is mounted on bit clamp carrier bar 136. A retainer bar 144 is secured to portions 146 of the bit clamp carrier bar 136 which extend outwardly to define recesses wherein the bit clamps 134 are positioned.

Figure 7:
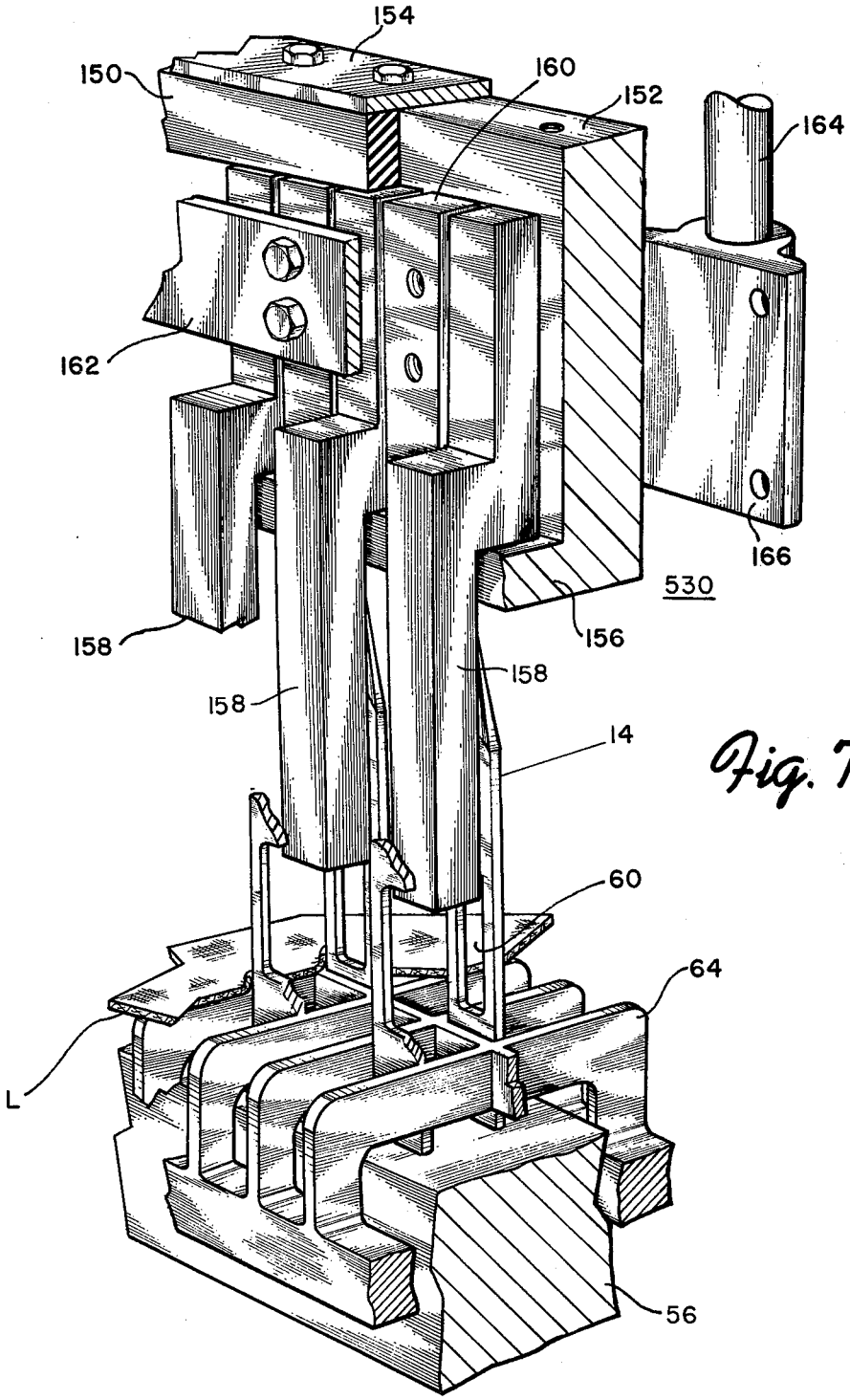
FIG. 7 is a perspective view in which the clamping means utilizes a strip of resilient material, such as rubber, for biasing the clamping means.

With reference to FIG. 7, 530 is another clamp means which includes the use of a resilient strip 150 of rubber or other suitable material positioned adjacent to the upper portion of bit clamp carrier bar 152. A cover plate 154 is secured to the top side of the bit clamp carrier bar 152 against which compression member 150 abuts. Bit clamps 158 are below the compression member 150 and a base portion 156 of the bit clamp carrier bar 152 extends beneath the upper portions of the bit clamps 158. Spacers 160 define recesses for the bit clamps 158 and are used to support retainer plate member 162. As in some of the previous embodiments, a drive bar 164 is secured to the foot member 166 which is secured to bit clamp carrier bar 152.

Figure 8:
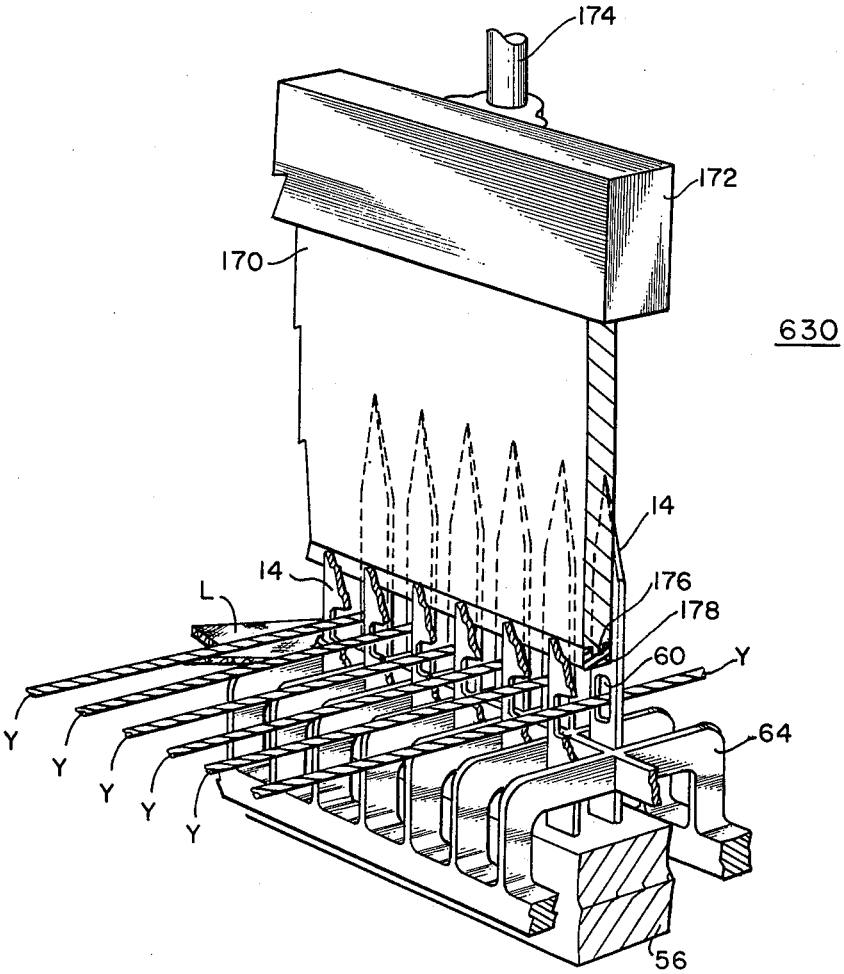
FIG. 8 is a perspective view in which the clamping means utilizes a facing strip of a resilient material, such as rubber.

With reference to FIG. 8, still another embodiment of yarn clamping means is shown as 630. A clamping member 170 may extend across the width of the tufting machine or a plurality of members like 170 may be used, each extending partly across the width of the machine. The clamping member 170 is secured to clamping bar member 172 which may be vertically reciprocated by drive bar 174 driven by cam 52 of FIG. 1, or other suitable reciprocating means.

The clamp member 170 may have a nub 176 running along its base to aid in securing resilient facing strip 178. This strip may be of rubber or other suitable material and may be secured to clamping member 170 by adhesive, mechanical (e.g., dovetailing) or other fastening means.

As readily observed in FIG. 8, the clamp member 170 with its resilient facing 178 runs widthwise of the machine between each pair of successive needles 14. When any yarn Y is loaded in its needle-pair and the clamp member 170 is applied, the resilient facing 178 holds the yarn in its position with regard to its needle-pair. The resilient facing 178 may be a strip of a bulk-resilient material such as rubber, neophrene, or the like. These materials may likewise be used for the strip 150 of FIG. 7.

As stated earlier, providing a resilient means for each yarn bit clamp, or for each group of several bit clamps, permits effective clamping of each yarn strand despite variations in yarn characteristics and variations in machine dimensions.

While various embodiments of the invention have been shown and described, it will be understood that various modifications may be made. The appended claims, therefore, are intended to define the true scope of the invention.

I claim:

1. Tufting apparatus for the production of tufted products comprising:

bit-applying elements for applying yarn to a backing layer to form tufts;

means for advancing yarn to said bit-applying elements;

clamping means, including a yarn engaging surface for preventing any substantial longitudinal movement prior to tufting of the yarn relative to said bit-applying elements whenever said clamping means engages said yarn, said clamping means further including resilient means disposed as a part of said clamp means; and means for disengaging said clamping means at desired times during the tufting cycle.

2. The tufting apparatus of claim 1 wherein said clamping means includes individual members and said resilient means comprises compression springs positioned to bias said members against said yarn and said means for disengaging said clamping means includes a lifter bar mechanism.

3. The tufting apparatus of claim 1 wherein said clamping means includes structure, a portion of which is said yarn engaging surface and said resilient means comprises spring members which bias said structure against said yarn.

4. The tufting apparatus of claim 1 wherein the clamping means comprises individual bit clamps and wherein the resilient means comprises a spring member to bias each bit clamp against said yarn.

5. The tufting apparatus of claim 1 wherein the clamping means comprises groups of bit clamps and wherein the resilient means comprises at least one spring to bias each group of bit clamps against said yarn.

6. The tufting apparatus of claim 1 wherein said clamping means comprises a structure and said resilient means comprises a strip of a bulk-resilient material positioned to bias said structure against said yarn.

7. The tufting apparatus of claim 1 wherein said clamping means comprises a structure and said resilient means comprises a compressed gas mechanism positioned to bias said structure against said yarn.

8. The tufting apparatus of claim 7 wherein the clamping means includes individual bit clamps and said compressed gas mechanism includes a compressed gas supply, and a piston for each bit clamp.

9. The tufting apparatus of claim 1 wherein said resilient means comprises a compressed gas mechanism and said means for engaging and disengaging said clamping means comprises pneumatic means for cyclically controlling gas pressure within said compressed gas mechanism.

10. Tufting apparatus having tufting stations at which pairs of needles are utilized to apply yarn to a backing layer, including yarn clamping means comprising:

a bit clamp for each individual tufting station, each said bit clamp being aligned between the two needles of each pair and operable to clamp yarn against said backing layer;

a clamping bar including a cantilever portion, said clamping bar being positioned adjacent said bit clamps with said upper cantilever portion extending over said bit clamps;

resilient means extending between said bit clamps and said cantilever structure of said carrier bar; and lifter bar means to overcome the bias of said resilient means and disengage said bit clamps.

11. Tufting apparatus including means for applying yarn tufts to a backing layer wherein the improvement comprises yarn clamping means having:

a clamping bar including a cantilever portion and recesses in a side wall;

bit clamps having a first portion slidably received in said recesses, a second portion having means for engagement with a resilient member and a lifter bar, and a third portion engageable with yarn, said bit clamps being positioned and operable in juxtaposition with said means for applying yarn tufts to a backing layer;

resilient means extending between said cantilever portion of said clamping bar and said second portion of said bit clamp, said resilient means designed to bias said bit clamps against the yarn;

a lifter bar designed to engage said second portion of said bit clamp; and means to vertically reciprocate said lifter bar whereby said bit clamp may be engaged and disengaged at desired times in the reciprocating cycle.

12. Tufting apparatus including means for applying yarn tufts to a backing layer wherein the improvement comprises yarn clamping means for clamping yarn prior to tufting having:

a pneumatic cylinder block including a compressed gas chamber and cylindrical bores within said block communicating with said compressed gas chamber;

pistons positioned in said cylindrical bores;

bit clamps depending from said pistons whereby gas pressure in said compressed gas chamber biases said bit clamps against the yarn; and reciprocable driving means attached to said pneumatic cylinder block so that said yarn clamping means may be reciprocated, whereby said bit clamps are driven into and out of engagement with yarn.

13. Tufting apparatus including means for applying yarn tufts to a backing layer wherein the improvement comprises yarn clamping means for clamping yarn prior to tufting having:

a pneumatic cylinder block including a compressed gas chamber and cylindrical bores within said block communicating with said gas chamber;

pistons positioned in said cylindrical bores;

bit clamps depending from said pistons whereby gas pressure in said compressed gas chamber biases said bit clamps against the yarn; and reciprocable valving means which cyclically changes the gas pressure in said pneumatic cylinder block to cause reciprocation of said bit clamps whereby yarn is clamped during a desired portion of the apparatus tufting cycle.

14. Tufting apparatus for the production of tufted products comprising:

reciprocable bit-applying elements movable through a backing to and from a threading position;

means for advancing yarn to thread said bit-applying elements;

backing support means to support said backing;

clamping means to hold the yarn securely against said backing as supported by said backing support means when loaded in the bit-applying elements during a desired period of the tufting operation, said clamping means including reciprocable driving means for engaging and disengaging said clamping means with the yarn;

biasing means for urging said clamping means into engagement with the yarn;

strand severing means for severing bit-lengths from the yarn;

means for actuating said strand-severing means; and means for driving said reciprocable bit-applying elements through said backing to deposit said bit-lengths of yarn.

15. The tufting apparatus of claim 14 wherein said biasing means comprises a wedge-shaped spring member.

16. The tufting apparatus of claim 14 wherein said biasing means comprises a strip of bulk-resilient material.

17. The tufting apparatus of claim 14 wherein said biasing means comprises pneumatic means.

18. The tufting apparatus of claim 14 wherein said biasing means comprises a compression spring.

19. The tufting apparatus of claim 14 wherein said biasing means comprises finger springs.

20. Tufting apparatus for the production of tufted products including:

reciprocable bit-applying elements movable through a backing to and from a threading position on at least one side of a backing;

means for advancing yarn to thread said bit-applying elements;

backing support means to support said backing;

clamping means to hold the yarn securely in the bit-applying elements and against said backing during a desired period of the tufting operation, said clamping means having a clamping member with a resilient member secured thereto so as to provide contact between the resilient member and the yarn; and strand-severing means for severing bit-lengths from the yarn.

* * * * *